US007048269B2

(12) United States Patent
Hoarau

(10) Patent No.: US 7,048,269 B2
(45) Date of Patent: May 23, 2006

(54) SYSTEMS AND METHODS OF EDGE PREPARATION FOR BINDING A TEXT BODY

(75) Inventor: Eric Hoarau, Mountain View, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 86 days.

(21) Appl. No.: 10/455,490

(22) Filed: Jun. 6, 2003

(65) Prior Publication Data

US 2004/0245694 A1 Dec. 9, 2004

(51) Int. Cl.
*B42B 9/00* (2006.01)

(52) U.S. Cl. ..... 270/52.17; 270/52.18; 270/52.09; 83/934; 83/904; 412/16; 412/1; 412/900

(58) Field of Classification Search ..... 270/52.09, 270/52.17, 52.16; 412/16, 1, 6, 8, 20, 25, 412/28, 29, 32, 33, 38, 39, 900, 902; 83/934, 83/904
See application file for complete search history.

(56) References Cited

U.S. PATENT DOCUMENTS

| | | | | |
|---|---|---|---|---|
| 4,077,078 | A | 3/1978 | Snellman et al. | |
| 4,150,453 | A | 4/1979 | Vaughn | |
| 4,911,475 | A | 3/1990 | Lerman | |
| 4,925,354 | A | 5/1990 | Cote | |
| 5,044,857 | A | 9/1991 | Crudo | |
| 5,052,872 | A | 10/1991 | Hunder et al. | |
| 5,078,425 | A | 1/1992 | Crudo | |
| 5,193,962 | A | 3/1993 | Parker et al. | |
| 5,271,794 | A | 12/1993 | Jarrell et al. | |
| 5,346,350 | A | 9/1994 | Luhman et al. | |
| 5,419,582 | A * | 5/1995 | Norris et al. | 281/5 |
| 5,536,044 | A | 7/1996 | Luhman et al. | |
| 5,702,220 | A | 12/1997 | Combs | |
| 6,024,525 | A | 2/2000 | Yamanaka | |
| 6,193,458 | B1 | 2/2001 | Marsh | |
| 6,440,254 | B1 | 8/2002 | Rich et al. | |
| 6,460,843 | B1 * | 10/2002 | Dim et al. | 270/58.07 |
| 6,641,345 | B1 * | 11/2003 | Cobene et al. | 412/1 |
| 6,752,578 | B1 * | 6/2004 | Ertel et al. | 412/8 |
| 6,773,034 | B1 * | 8/2004 | Melcher | 281/38 |
| 2002/0067977 | A1 * | 6/2002 | Cobene et al. | 412/1 |
| 2002/0106264 | A1 | 8/2002 | Cobene, II, et al. | |
| 2002/0119029 | A1 | 8/2002 | Cobene et al. | |
| 2002/0168248 | A1 | 11/2002 | Ertel et al. | |
| 2002/0182033 | A1 * | 12/2002 | Weiss | 412/1 |

FOREIGN PATENT DOCUMENTS

| | | |
|---|---|---|
| WO | WO99/38707 | 8/1999 |
| WO | WO 200040425 A1 * | 7/2000 |
| WO | WO02/090122 | 5/2002 |

* cited by examiner

*Primary Examiner*—Patrick Mackey

(57) ABSTRACT

A system for binding sheets into a bound text body includes a non-linear sheet cutter configured to cut sheets to form pairs of sheets each sheet in the pair having a non-linear edge. A sheet collector forms a text body from the pairs of sheets with the non-linear edges of the sheets adjacent one another and an adhesive applicator applies adhesive to the non-linear edges for binding the text body into a bound text body. The system for binding sheets increases the spinal area exposed for adhesive penetration on a text body to increase the binding strength of the bound text body.

20 Claims, 2 Drawing Sheets

SYSTEMS AND METHODS OF EDGE PREPARATION FOR BINDING A TEXT BODY

DESCRIPTION OF THE RELATED ART

Today, a variety of different bookbinding systems can deliver professionally bound documents, including books, manuals, publications, annual reports, newsletters, business plans, and brochures. A bookbinding system generally may be classified as a commercial (or trade) bookbinding system that is designed for in-line manufacturing of high quality volume runs or an in-house (or office) perfect binding bookbinding system designed for short "on-demand" runs. Commercial bookbinding systems generally provide a wide variety of binding capabilities, but require large production runs (e.g., on the order of thousands of bindings) to offset the set-up cost of each production run and to support the necessary investment in expensive in-line production equipment. Office bookbinding systems, on the other hand, generally involve manual intervention and provide relatively few binding capabilities, but are significantly less expensive to set up and operate than commercial bookbinding systems, even for short on-demand production runs of only a few books.

In general, a bookbinding system collects a plurality of sheets (or pages) into a text body (or book block) that includes a spine and two side hinge areas. The bookbinding system applies an adhesive to the text body spine to bind the sheets together. A cover may be attached to the bound text body by applying an adhesive to the side hinge areas or the spine of the text body, or both. The cover of a typical commercial soft cover book generally is attached to the text spine. The covers of hardcover books and some soft cover "lay flat" books, on the other hand, typically are not attached to the text body spines (i.e., the spines are "floating").

Many different systems have been proposed for applying adhesive to a text body spine to bind the text body sheets together.

For example, U.S. Pat. No. 5,346,350 discloses an apparatus for binding sheets that includes an aligning plate that aligns the sheets edges at the spine edge, and two clamping plates that hold the sheets during binding. A heating platen heats and melts a backless solid hot melt adhesive that is placed along the sheet edges. The hot melt adhesive binds the sheets together at the spinal area. According to the '350 patent:

> "Capillary action is the preferred primary mechanism by which the adhesive flows into the stack 12 to bond the paper sheets together. Capillary action assists both the adhesion of the adhesive material 94 to the stack of paper 12 and the internal cohesion within the adhesive material 94.
>
> Additionally, the platen 120 of the heating subsystem 118 does not push the adhesive 94 into the edge 13 of the stack 12. Ideally, the platen 120 applies zero pressure against the stack 12 and only contacts the adhesive material sheet 94 sufficiently to melt the adhesive 94 so that the gravity-assisted capillary action causes the liquid adhesive 94 to wick into and bond the stack 12 together. Putting pressure on the adhesive 94 in an attempt to push it into the stack 12, whether pushing downwardly, upwardly, or sideways, would not enhance bonding. Rather, this would squeeze the adhesive off the edge 13 and off of the stack 12 through the sides between the platen 120 and the stack 12 and defeat the effects of capillary action. Thus, the platen is designed to apply only minimal pressures on the edge 13 of the stack 12 to maintain contact between the platen 120, the adhesive 94 and the stack 12." (Column 8, line 60 through column 9, line 29)

The hot melt adhesive also may be used to attach a preformed book cover to the text body spine.

International Patent Publication No. WO 99/38707 discloses a paperback bookbinding scheme in which a cover with an adhesive strip disposed along a spine area is forced between a pair of pressing rollers to form a pocket, and a text body is inserted into the pocket with the text body spine in contact with the adhesive strip. The pressing rollers are moved forcibly toward one another to compress the cover firmly against the front and back sides of the text body and to compress the text body sheets together tightly in the area adjacent to the spine. A sonic tool transmits sonic energy to the cover to activate the adhesive strip and, thereby, bind the text body sheets and the cover into a perfectly bound book.

U.S. Pat. No. 4,911,475 discloses a bookbinding construction in which sheets are bound together into a book block by two or more spaced-apart transverse segments of adhesive. The front section of a cover is attached to the first page of the book block and the back section of the cover is secured to the last page of the book block. Upon opening the book or turning a page, glue-free portions of the spine edge of the open page flex or bow outward over the facing page in a wedging manner or interfering fit. According to the '475 patent, this wedging action against the oppose page resists the tendency of the book to spring closed and forces the pages of the book to lie flat.

U.S. Pat. No. 5,271,794 discloses an adhesive applicator that is configured to spread coat an adhesive onto the spine and side edges of a text body to bind the text body sheets and a cover into a perfectly bound book with an attached spine. The adhesive applicator includes a book spine coating nozzle with adjustable side sealing jaws for adjusting the nozzle width for different book thicknesses and sides. Glue flow control valves are disposed between the spine coating nozzle and the side glue outlets so the glue deposited on the book sides may be selectively and independently cut off or controlled.

Since the binding strength of the bound media bodies produced using the perfect binding techniques depends on the adhesion of individual sheets of paper to the adhesive material, the edge preparation method is an important part of a perfect binding technique to ensure pages of the resulting bound text bodies are securely fastened. Various methods exist to prepare the binding edges of individual sheets of paper. One edge preparation method involves making slits on the binding edges of stacked sheets of paper using a large wheel with teeth. Another edge preparation method involves milling the folded edges of stacked sheets using a grinder to produce rough edges on the resulting individual sheets.

One concern with the slitting and milling methods is that dangerous heavy machinery is needed to make the slits on the binding edges of the stacked sheets of paper or to mill the folded edges of the stacked sheets. This heavy machinery is not suitable for an office environment because it is heavy, bulky, and dangerous. For the slitting method, another concern is that the depth of the slits is hard to control. For the milling method, another concern is that a significant amount of paper dust is created, which can interfere with the proper operation of the machinery. Furthermore, for the milling method the resulting three sides of the sheets must be trimmed creating paper waste, which is difficult to handle and collect for disposal.

Other edge preparation methods include notch and burst binding methods. In the notch binding method, notches are made on the folded edges of the sheets by removing small sections of the folded sheets to allow penetration of the adhesive material into the individual folded sheets. Similarly, in the burst binding method, large cuts are made on the folded edges of the sheets to allow penetration of the adhesive material into the individual folded sheets through the cuts. Use of heavy machinery is also a problem with these methods. Handling of small paper waste is very difficult to manage since residual static in the sheets can cause the paper waste to stick to the sheets.

Still other bookbinding systems have been proposed.

SUMMARY

The present invention relates to novel systems and methods of edge preparation for binding a text body.

In one embodiment, a system for binding sheets into a bound text body comprises a non-linear sheet cutter configured to cut sheets to form pairs of sheets each sheet in the pair having a non-linear edge, a sheet collector configured to form a text body from the pairs of sheets with the non-linear edges of the sheets adjacent one another, and an adhesive applicator configured to apply adhesive to the non-linear edges for binding the text body into a bound text body.

In another embodiment, a system for preparing sheets for binding into a text body comprises a sheet supply of printed sheets, a non-linear sheet cutter configured to receive the printed sheets and cut the printed sheets to form pairs of sheets each sheet in the pair having a non-linear edge, and a sheet collector configured to form a printed text body from the pairs of sheets with the non-linear edges of the sheets adjacent one another.

In a further embodiment, a method of preparing sheets for binding into a text body comprising cutting at least one printed sheet with a non-linear sheet cutter to form cut sheets each with one non-linear edge, assembling the cut sheets with the non-linear edges adjacent one another, and repeating the cutting and assembling steps to form a text body.

In an additional embodiment, a system for binding sheets into a bound text body includes means for forming a non-linear cut in a printed sheet to create a pair of sheets each having a non-linear edge, means for assembling a plurality of pairs of sheets with the non-linear edges arranged together to form a text body with the non-linear edges forming a text body spine, and means for binding the one or more pairs of sheets along the spine.

BRIEF DESCRIPTION OF THE DRAWING FIGURES

The binding system will now be described in greater detail with reference to the preferred embodiments illustrated in the accompanying drawings, in which like elements bear like reference numerals, and wherein.

DETAILED DESCRIPTION OF THE INVENTION

Figure 1:
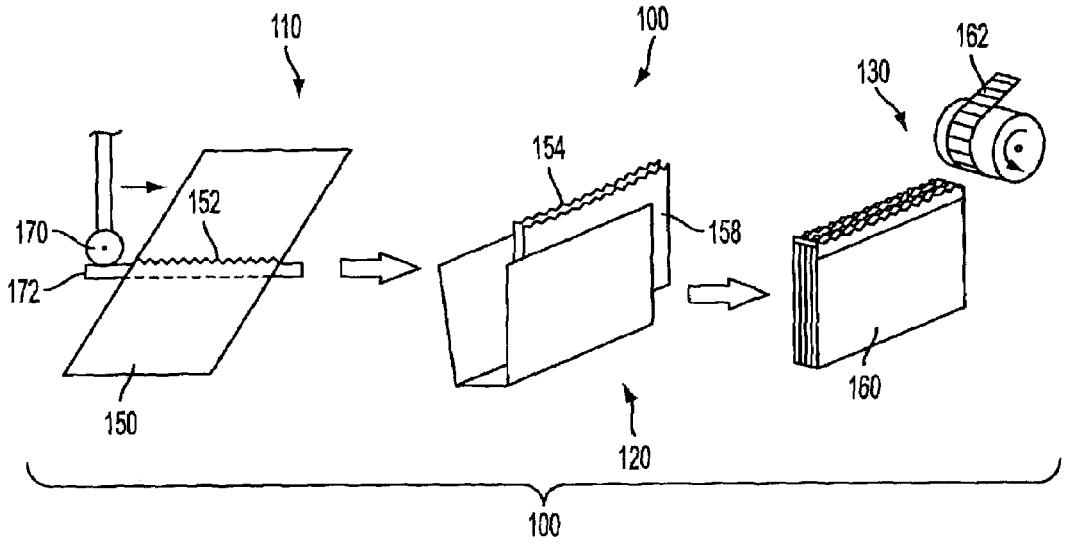
FIG. 1 is a diagrammatic perspective view of a system of binding sheets.

Referring to FIG. 1 a system for binding sheets 100 includes a sheet cutter 110, a sheet collector 120, and an adhesive applicator 130. The system for binding sheets 100 increases the spinal area exposed for adhesive penetration on a text body to increase the binding strength of the bound text body.

In the embodiment if FIG. 1, sheets 150 which can be printed sheets having a size which is two times the size of the finished booklet size are fed into the sheet cutter 110. The sheet cutter 110 cuts the sheet with a non-linear cut 152 along substantially the center line of the sheet 150 to form a pair of sheets of equal or substantially equal sizes. The non-linear cut 152 is made without removing any material from the sheet. Consequently, virtually no paper waste is generated as a result of this processing step. In addition, only minimal amount of paper dust is generated.

The cut sheets 158 each having one non-linear edge 154 are then stacked in the sheet collector 120 with the non-linear edges of the sheets 154 adjacent one another. The sheet collector 120 collects multiple pairs of cut sheets 158 to form an assembled text body 160 which receives adhesive from the adhesive applicator 130. The adhesive applicator 130 may also be used to attach a cover to the bound text body to produce a bound book with a floating or attached spine.

The use of the sheet binding system which starts with a sheet twice the size of the finished book and performs edge preparation with a non-linear cutter provides several advantages. The sheet binding system completely eliminates paper waste associated with known edge preparation systems. The elimination of paper waste and reduction of dust can result in improved system performance and reduced maintenance requirements.

The adhesive applicator 130 may apply a preformed solid hot melt adhesive strip 162. The strip 162 may be heated or otherwise activated to cause melted liquid adhesive to flow into gaps between the sheets. One example of an adhesive applicator system is described in WO 02/090122 published Nov. 14, 2002 to John P. Ertel and entitled "DISPENSING SOLID SHEET ADHESIVE IN A BOOKBINDING SYSTEM," which is incorporated herein by reference in its entirety.

After formed hot melt adhesive has re-solidified to bind the text body sheets into a bound text body 160, the bound text body may be subjected to one or more additional processing steps. For example, a cover may be attached to the bound text body as described in co-pending U.S. patent application Ser. No. 09/721,549, filed Nov. 24, 2000 by Robert L. Cobene et al., and entitled "SYSTEMS AND METHODS OF ATTACHING A COVER TO A TEXT BODY," U.S. patent application publication number US 2002/0119029, published Aug. 29, 2002 to Robert L. Cobene et al., and entitled "SYSTEMS AND METHODS OF REGISTERING A COVER WITH RESPECT TO A TEXT BODY," and U.S. patent application Ser. No. 10/231,037, filed Aug. 30, 2002 by Robert L. Cobene et al., and entitled "AN APPARATUS AND METHOD FOR ATTACHING A COVER TO AN ASSEMBLY OF SHEETS," which are incorporated herein by reference in their entirety.

The non-linear edges 154 of the text body 160 formed along the spine may take on a variety of different configurations depending on the configuration of the sheet cutter employed.

Figure 2A:
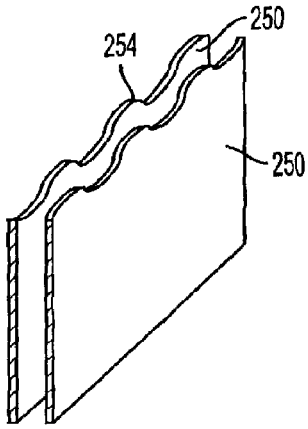
FIG. 2A is a perspective view of a pair of sheets which have been cut by the system of FIG. 1.
Figure 2B:
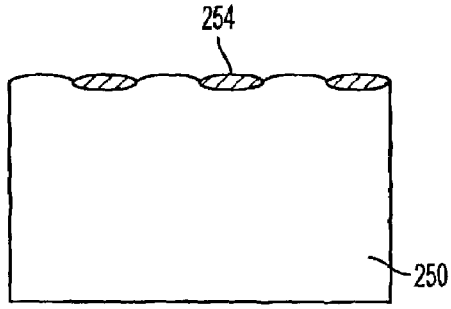
FIG. 2B is a side view of the pair of sheets of FIG. 2A.

For example, in one embodiment, the non-linear sheet edges are characterized by periodic variations at the spine edge which may have any form of repeating pattern including the sinusoidal shaped edge pattern 254 shown on the sheets in FIGS. 2A and 2B. Other patterns include polygonal, elliptical, notched, or irregular patterns. The non-linear edge 254 may also be formed by embossing and/or punching in addition to cutting. As shown in FIGS. 2A and 2B the cutting of the sheets in a sinusoidal or other repeating pattern results in the alternating pattern illustrated in FIG. 2B when the sheets are assembled adjacent one another.

The non-linear patterned cut 254 can have an amplitude of about 0.1 mm to about 3 mm, preferably about 0.5 mm to about 1.5 mm.

Figure 2C:
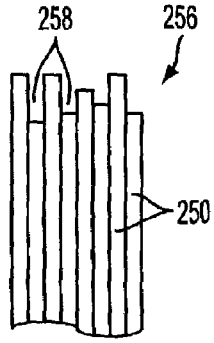
FIG. 2C is an end view of a portion of a plurality of the sheets of FIGS. 2A and 2B.

FIG. 2C illustrates the stacked sheets 250 with the text body spine 256 having spaces and gaps 258 into which the adhesive will flow. The text sheets 250 created by cutting the sheets substantially along the center line are assembled by the sheet collector preferably with the edge variations of adjacent sheets 180° out of phase as shown in FIGS. 2A and 2B to increase the spinal surface area exposed for adhesive penetration.

Figure 3:
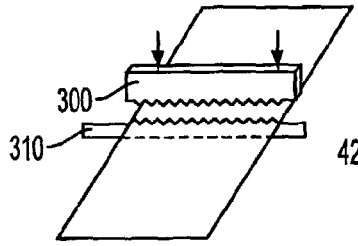
FIG. 3 is a perspective view of one embodiment of a guillotine cutter blade.
Figure 4:
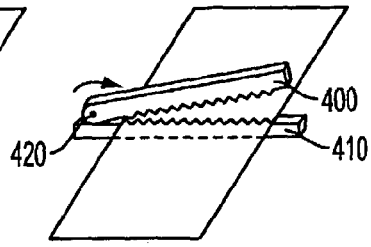
FIG. 4 is a perspective view of one embodiment of a hinged cutter blade.

Referring to FIGS. 1, 3, and 4, the sheet cutter for forming the non-linear edges of the sheets may take on a variety of configurations. In one embodiment, a rotary cutting blade 170 and a mating notched blade 172 form a notched non-linear edge 154. For example, the cutting wheel 170 of FIG. 1 cuts a notched edge in association with a similarly notched cutting blade 172. Cutting blades 170, 172 with a wavy, sinusoidal, elliptical, irregular, or other shaped cutting edge can be used to cut other patterns.

FIG. 3 illustrates a guillotine type non-linear movable blade 300 associated with a stationary non-linear cutting edge 310 to form the sheet cutter. In the FIG. 3 embodiment, one or both of the blades 300, 310 can be movable.

FIG. 4 illustrates a hinged type non-linear movable blade connected by a hinge 420 to a fixed non-linear blade 410. In the FIG. 4 embodiment, one or both of the blades 400, 410 can be movable.

The sheet cutters in the embodiments of FIGS. 1, 3, and 4, have been illustrated with an upper blade which comes into contact with a lower blade and cuts the paper in a scissor-like manner. Alternatively, the upper blade can perform cutting by pressing through the sheet into a resilient cutting surface located below the sheet or an upper blade can cut through a sheet while passing along a groove in a lower cutting surface. Other known cutting arrangements may also be used.

Figure 5:
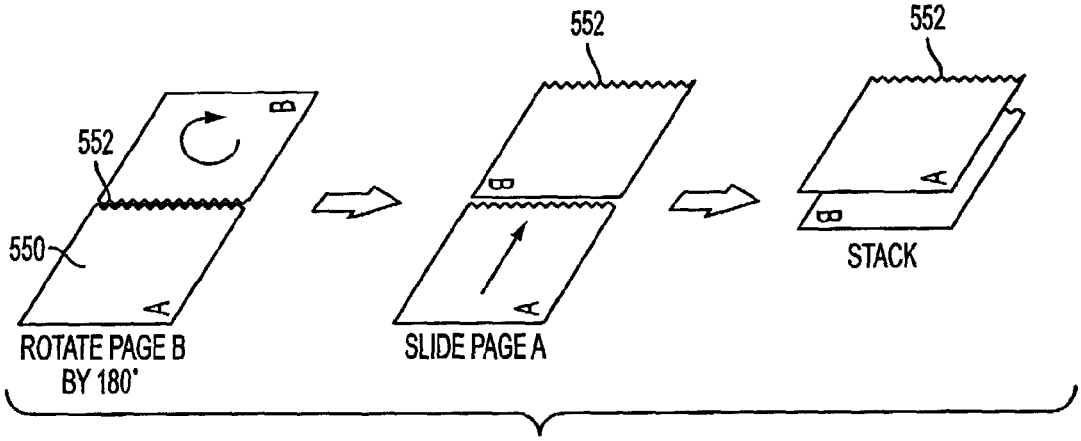
FIG. 5 is a schematic diagram of one sheet collection process.

FIG. 5 illustrates one example of a sheet collection process in which a sheet 550 is cut substantially along a center line with a non-linear cut 552 to form sheets A and B each having non-linear edges. Sheet B is then rotated 180° by known paper transport devices. Pages A and B are then stacked by transporting page A and/or page B with a paper drive until the non-linear edges 552 are aligned. This process is then repeated with each of the sheets 550 to form a text body. The stacked sheets are aligned by alignment guides (not shown) of the sheet collector into the text body for binding.

Figure 6:
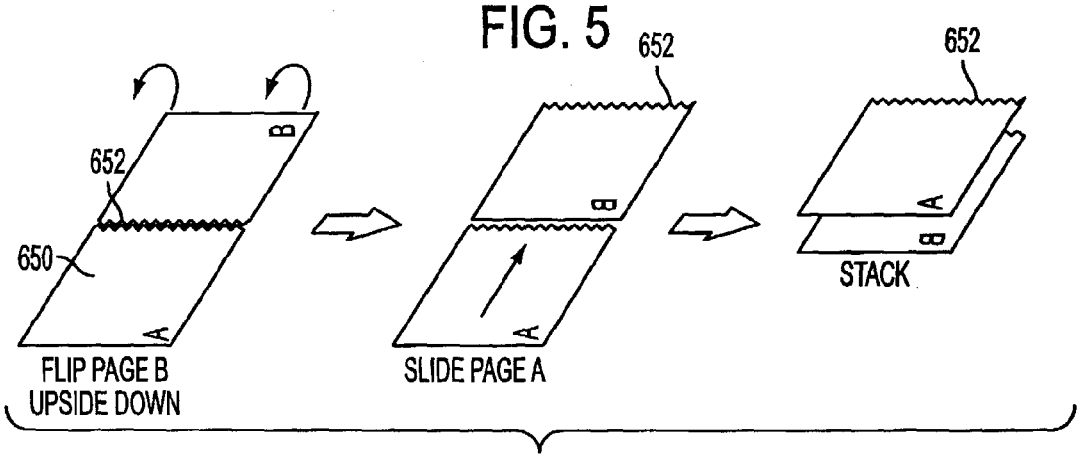
FIG. 6 is a schematic diagram of another sheet collection process.

FIG. 6 illustrates an alternative embodiment of the sheet collection process in which a sheet 650 is cut substantially along a center line with a non-linear cut 652 to form sheets A and B. One of the sheets A or B is then inverted. In FIG. 6, sheet B is inverted and the sheets are moved together and stacked as in the embodiment of FIG. 5.

The sheets in each of the embodiments described above are preferably printed prior to cutting and stacking. Thus, the location and orientation of printing on the sheets must be determined based on the sheet collection process which will be used to stack the cut sheets into the assembled text body.

Figure 7:
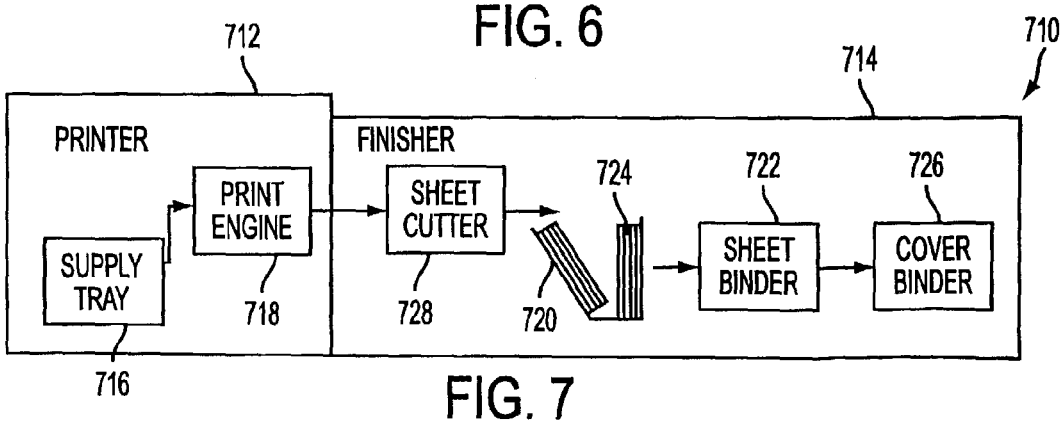
FIG. 7 is a diagrammatic side view of a system for binding sheets.

Referring to FIG. 7, in one embodiment, a bookbinding system 710 includes a printer 712 and a finisher 714. Bookbinding system 710 may be implemented as a desktop or office bookmaking system designed to satisfy on-demand bookbinding needs. Printer 712 may be a conventional printer (e.g., a LaserJet® printer available from Hewlett-Packard Company of Palo Alto, Calif., U.S.A.) that includes a supply tray 716 that is configured to hold a plurality of sheets (e.g., paper sheets), and a print engine 718 that is configured to apply markings onto the sheets received from supply tray 716.

Finisher 714 includes a sheet cutter 728, a sheet collector 720, and a sheetbinder 722. Sheetbinder 722 includes an adhesive applicator. The sheetbinder 722 is configured to bind the text body 724 collected in the sheet collector 720 into a bound text body. A cover binder 726 is configured to attach a cover to the bound text body.

In operation, sheets are fed from supply tray 716 to print engine 718, which prints text, pictures, graphics, images and other patterns onto the sheets in an orientation, order, and arrangement which is determined based on a stacking method selected and the final text arrangement desired in the finished book. The printed sheets are cut substantially along a center line by the sheet cutter and fed to sheet collector 720, which collects and aligns the sheets into a text body 724 with an exposed spine having a plurality of non-linear sheet edges bounded by two exposed side hinge areas. The text body 724 is conveyed to sheetbinder 722. The sheet binder 722 binds the sheets of text body 724 by application of adhesive to the non-linear edges, and the cover binder 726 attaches a cover to the bound text body to produce a bound book 726 with a floating or attached spine.

The finisher 714 may also include trimmers, punches, perforators, and other finishing systems if desired.

In sum, the above-described embodiments incorporate novel systems and methods for increasing the binding strength of a bound text body in a manner that can improve the performance and cost-effectiveness of desktop and office on-demand bookbinding systems.

Other embodiments are within the scope of the claims. For example, other embodiments may combine features of two or more of the above-described embodiments to increase the spinal surface area exposed for adhesive penetration and, thereby, increase the binding strength of a bound text body.

While the embodiments have been described in detail herein, it will be apparent to one skilled in the art that various changes and modifications can be made and equivalents employed, without departing from the claims.

What is claimed is:

1. A system for binding sheets into a bound text body, comprising:

a non-linear sheet cutter configured to cut a sheet along a center line to form a pair of separated sheets, each sheet in the pair having a non-linear edge;

a sheet collector configured to form a text body from the pair of sheets with the non-linear edges of the sheets adjacent one another; and an adhesive applicator configured to apply adhesive to the non-linear edges for binding the text body into a bound text body.

2. The system of claim 1, wherein the sheet cutter includes a rotary blade having a non-linear patterned cutting edge.

3. The system of claim 1, wherein the sheet cutter includes a movable blade having a non-linear patterned cutting edge.

4. The system of claim 1, wherein the sheet collector collects the sheets with adjacent sheets formed by the pair of separated sheets having the non-linear patterns out of phase.

5. The system of claim 1, comprising a printer configured for printing the sheets, wherein the sheet cutter is configured to receive printed sheets from the printer.

6. The system of claim 1, wherein the sheet cutter forms the pair of sheets having non-linear edge patterns in which the pattern of one sheet of the pair is opposite to the pattern of the other sheet of the pair.

7. The system of claim 1, wherein the sheet collector forms a text body having one edge of the text body formed of non-linear sheet edges and three edges of the text body formed of linear sheet edges.

8. The system of claim 1, wherein the sheet cutter is configured to form the pair of sheets of substantially equal sizes.

9. A system for preparing sheets for binding into a text body, comprising:

a sheet supply of printed sheets;

a non-linear sheet cutter configured to receive the printed sheets and to cut each printed sheet along a center line to separate the printed sheet into a pair of separated sheets, each sheet in the pair having a non-linear edge; and a sheet collector configured to form a printed text body from the pairs of sheets with the non-linear edges of the sheets adjacent one another.

10. The system of claim 9, wherein the sheet cutter includes a rotary blade having a non-linear patterned cutting edge.

11. The system of claim 9, wherein the sheet cutter includes a movable blade having a non-linear patterned cutting edge.

12. The system of claim 9, wherein the sheet collector collects the sheets with adjacent sheets formed by the pair of separated sheets having the non-linear patterns out of phase.

13. A method of preparing sheets for binding into a text body, the method comprising:

cutting at least one printed sheet with a non-linear sheet cutter along a center line of the sheet to form a pair of separated cut sheets each with one non-linear edge;

assembling the cut sheets with the non-linear edges adjacent one another; and repeating the cutting and assembling steps to form a text body.

14. The method of claim 13, comprising applying adhesive to the non-linear edges of the text body to form a bound text body.

15. The method of claim 13, wherein the separated cut sheets are assembled with the adjacent sheets having non-linear patterns out of phase.

16. A system for binding sheets into a bound text body, comprising:

means for forming a non-linear cut along a center line of a printed sheet to create a pair of separated sheets each having a non-linear edge;

means for assembling a plurality of pairs of sheets with the non-linear edges arranged together to form a text body with the non-linear edges forming a text body spine; and means for binding the one or more pairs of sheets along the spine.

17. The system of claim 16, wherein the means for forming a non-linear cut comprises a non-linear patterned blade.

18. The system of claim 16, wherein the means for binding includes an adhesive applicator.

19. The system of claim 16, wherein the means for forming a non-linear cut increases a spinal area exposed for binding along the spine compared to a spine with sheets having a linear edge.

20. The system of claim 4, wherein the separated sheets of the pair have non-linear patterns 180° out of phase with one another.

* * * * *